United States Patent [19]

Hesch et al.

[11] Patent Number: 4,917,019

[45] Date of Patent: Apr. 17, 1990

[54] RAILWAY FREIGHT CAR

[75] Inventors: Harold E. Hesch, St. John; Phillip G. Przybylinski; Robert P. Sellberg, both of Schererville, all of Ind.

[73] Assignee: Trinity Industries, Inc., Dallas, Tex.

[21] Appl. No.: 353,167

[22] Filed: May 12, 1989

Related U.S. Application Data

[63] Continuation of Ser. No. 114,175, Oct. 28, 1987, abandoned.

[51] Int. Cl.[4] ..... B61D 3/10

[52] U.S. Cl. ..... 105/4.1; 105/416; 105/421; 410/52

[58] Field of Search ..... 105/3, 4.1, 404, 413, 105/414, 410, 416, 418, 419, 420, 421, 422, 425; 410/44, 52, 78, 90, 94

[56] References Cited

U.S. PATENT DOCUMENTS

| | | | |
|---|---|---|---|
| 1,499,510 | 7/1924 | Elliot | 105/3 X |
| 1,599,474 | 9/1926 | Koch | 105/4.1 |
| 2,697,990 | 12/1954 | Parsons et al. | 105/414 X |
| 3,207,086 | 9/1965 | Mowatt-Larssen et al. | 105/368 |
| 3,295,465 | 1/1967 | Borger | 105/414 X |
| 3,527,171 | 9/1970 | Stark | 105/416 X |
| 3,568,607 | 3/1971 | Gutridge | 410/71 X |
| 3,577,933 | 3/1971 | Ferris et al. | 105/422 X |
| 3,616,764 | 11/1971 | Johnson et al. | 105/366 |
| 3,721,199 | 3/1973 | Hassenauer | 410/77 |
| 4,194,451 | 3/1980 | Dehner | 105/416 |
| 4,235,170 | 11/1980 | Bauer | 105/421 X |
| 4,274,776 | 6/1981 | Paton et al. | 410/57 |
| 4,665,834 | 5/1987 | van Iperen | 105/4.1 |
| 4,686,907 | 8/1987 | Wollam et al. | 105/4.1 |
| 4,750,431 | 6/1988 | Yates | 105/421 X |

*Primary Examiner*—Andres Kashnikow
*Assistant Examiner*—Mark T. Le
*Attorney, Agent, or Firm*—Myers & Ehrlich, Ltd.

[57] ABSTRACT

A railway car comprises a center sill with a crossbearer, webs and end bolsters extending across thereof. A light side stiffener interconnects the projecting ends of said webs and spans between the bolster and the crossbearer. A shear plate covers a trapezoidal end frame extending from the bolster. The frame includes inclined braces buttressing a pair of cantilivered brackets projecting toward and horizontally overlapping similar brackets of the adjacent car.

28 Claims, 4 Drawing Sheets

RAILWAY FREIGHT CAR

This application is a continuation of application Ser. No. 114,175, filed Oct. 28, 1987, now abandoned.

BACKGROUND OF THE INVENTION

This invention pertains to railroad cars and more particularly to a structure of a freight spine car.

Spine cars carry freight containers mounted on a spine-like car platform. A spine car generally includes a center beam with a series of parallel crossbearers extending transversely of the beam.

The containers are generally detachably secured on a spine car by container locks on crossbearers or bolsters on the car. These locks receive vertical loads for the weight of the containers. The locks also receive impact loads in a horizontal plane in resisting the tendency of a container to slide off the car during acceleration, deceleration, or cornering of the car.

Weight of a railway car is at a great premium, and an important goal of railway car design. To reduce weight by reducing the number of wheeled trucks needed in a railway car train, it is well known in the prior art to provide an articulated connection between two cars wherein an end of each car is pivotally supported on a truck. To limit tilt of the car with respect to the truck, the cars are usually provided with side bearing arms extending over the truck laterally outward of the pivotal connection. The side bearing arms contact bearings on the truck, preventing significant tilting of the car with respect to the truck.

However, no spine car is presently available which supports containers while taking advantage of the use of articulation between cars, and more particularly provides an efficient railway car structure for bearing horizontal impact loads from container locks and loads from side bearing arms.

Various spine cars heretofore disclosed are exemplified in the following patents. U.S. Pat. No. 3,616,764, issued to Johnson et al., shows a railway container car including a pair of I-beam side sills and a boxlike center sill interconnected by angled cross member. Another U.S. Pat. No. 4,274,776, issued to Paton et al., teaches a container railcar with a depressed midsection and a four point truck suspension.

SUMMARY OF THE INVENTION

Accordingly it is an object of this invention to provide an articulated spine car for the transport of containers.

It is a further object of this invention to provide an efficient end structure for such a spine car.

In the spine car of this invention, the side bearing arms of the articulated end frame structure are supported laterally outwardly from the center sill of the car by a transverse end sill and a longitudinally inward transverse bolster. The bolster extends laterally outward beyond the side bearing arms to support container locks at the lateral sides of the car. A diagonal beam is connected to the bolster adjacent a respective container lock and to the side bearing arm to form a truss structure to support the container. The end frame structure is additionally reinforced by a shear plate attached over the end frame structure to aid in bearing lateral shear loads from impact loads and loads in the side bearing arms.

DESCRIPTION OF THE PREFERRED EMBODIMENT

Figures 1, 2, 3:
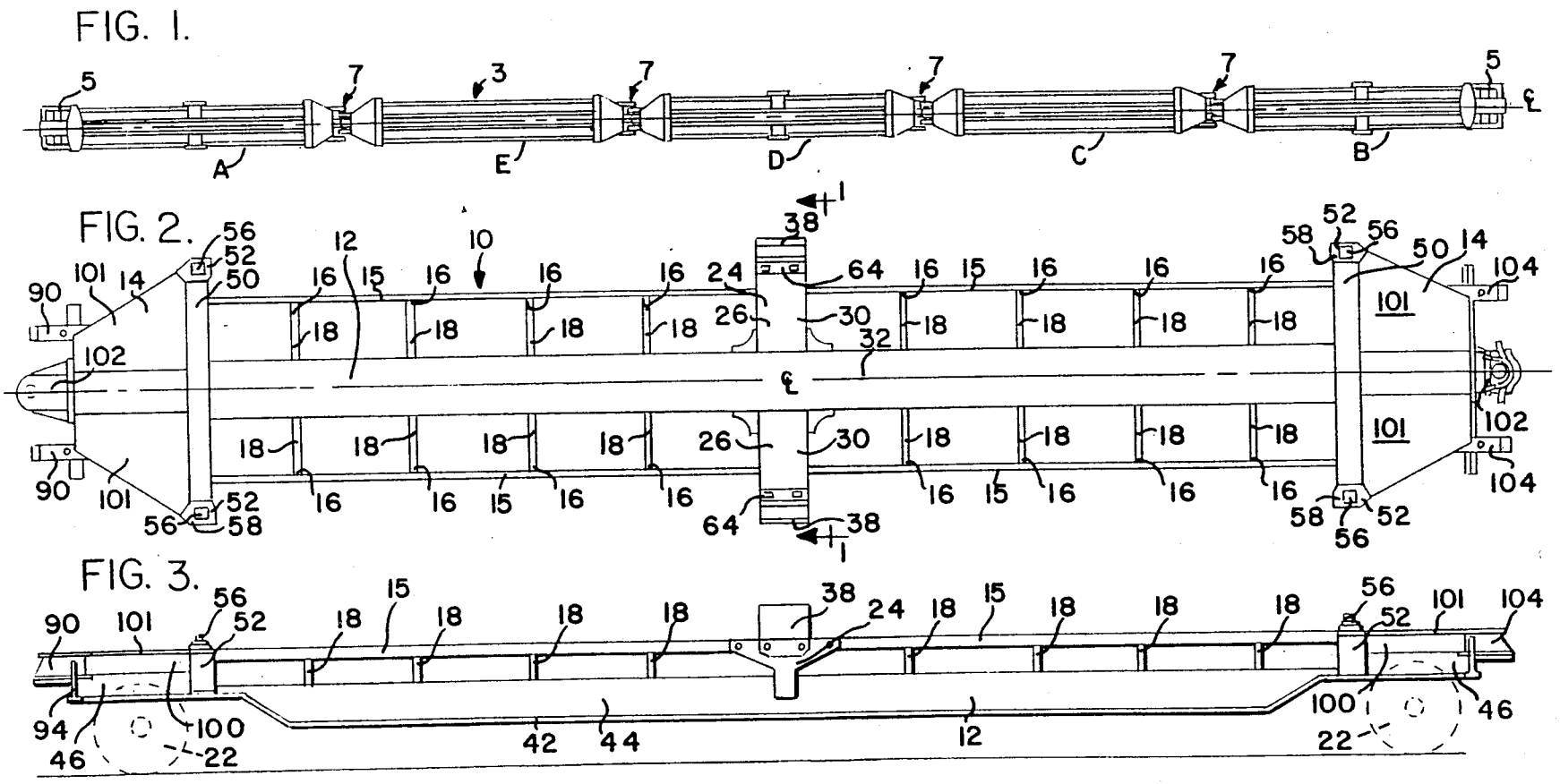
FIG. 1 is a schematic top view of a train of articulated spine cars of the invention.
FIG. 2 is a top view of an intermediate spine car in the train.
FIG. 3 is a side view of the spine car shown in FIG. 2.

FIG. 1 shows a schematic plan view of a train 3 formed of five serially connected articulated spine cars. It would be understood that articulated trains may have varying numbers of cars, ranging from a two car train having two cars articulatedly connected to each other to a train having considerably more than five cars.

In the five-car train embodiment shown in FIG. 1, a first end car A is provided with a coupler connection end 5 for connection with a conventional coupler railway car (not shown). The opposite end of the first end car A is connected with an end of intermediate car E to form an articulated connection 7. Intermediate cars E, D, C, are serially connected by articulated connections 7. End car B has a coupler connection end for connection to a second conventional coupler railway car (not shown).

FIG. 2 shows a car 10 which is exemplary of the intermediate cars C, D, and E. The car 10 includes a longitudinally extending center sill 12. A pair of end frame structures 14 are supported on the center sill 12 at the car ends to facilitate articulated interconnection between the cars. Light side sills 15 extend longitudinally between the end frame structures 14. The side sills 15 are connected to the lateral ends 16 of crossbearers 18. The adjacent ends of cars share a common double-axle swivelable truck 22 (shown in phantom lines). The articulated connections shorten the length of the train and reduce cost and weight by reducing the number of trucks needed.

Figure 6:
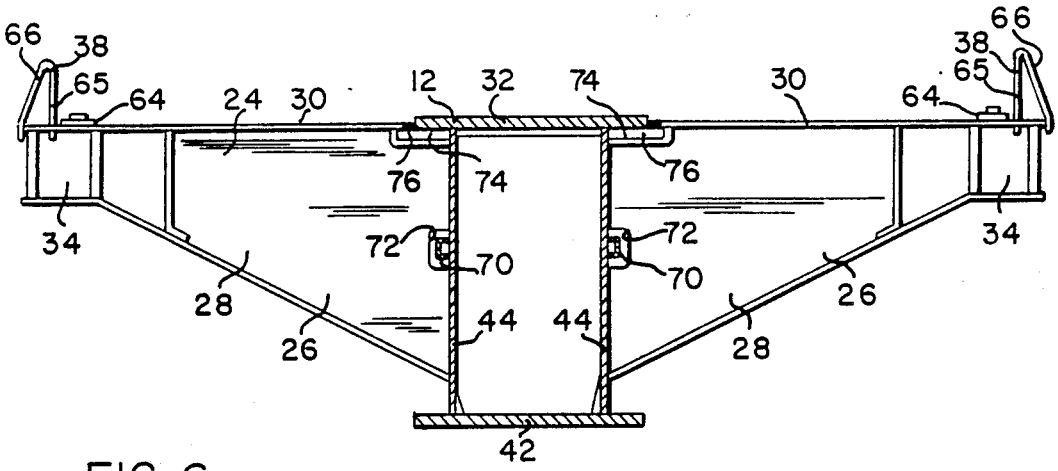
FIG. 6 a cross-sectional view taken substantially along the line 1—1 of FIG. 2.
Figure 7:
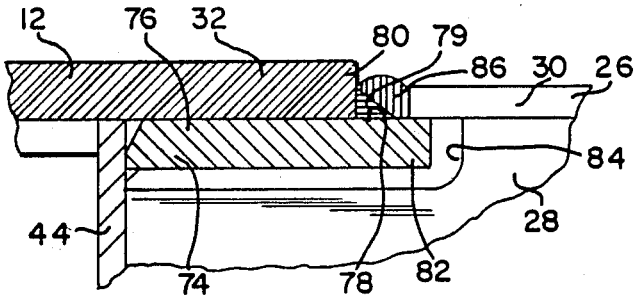
FIG. 7 is an enlarged detail view of the crossbearer shown in FIG. 6 and shows the connection of the crossbearer to the center sill.
Figure 8:
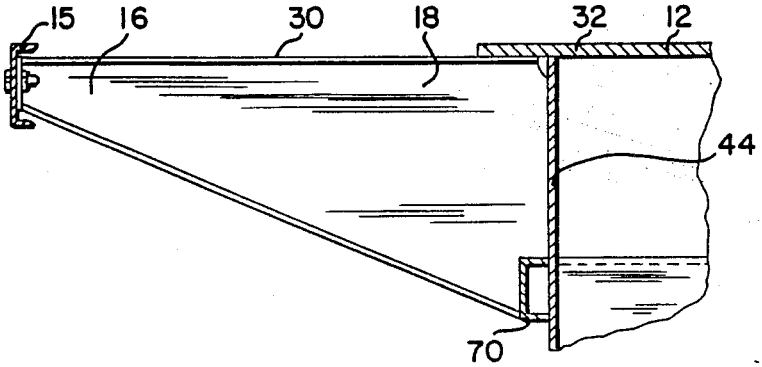
FIG. 8 is an enlarged view of a web-to-sill attachment.

A crossbearer assembly 24 located in the middle of the car beams loads in the side sills 15 laterally inward to the center sill 12. The crossbearer assembly 24 includes a pair of I-beam crossbearers 26 each of which has a pair of generally triangular sections 28 rigidly secured to the center sill 12. A top plate 30 covering the crossbearer 26 is connected with the center sill top wall 32. The plate 30 as best seen in FIG. 7 has its top load-carrying surface above the top of plate 32 and below the load carrying pad 64 as seen in FIG. 6. The lateral ends 34 of the crossbearer 26 each supports a container guide or support shoe 38.

The center sill 12 has a top wall 32, bottom wall 42 and a pair of side walls 44. The center sill height is decreased adjacent the longitudinal ends 46 thereof, shown in FIG. 4, to accommodate mounting of the car 10 on the respective trucks.

Bolsters 50 extend laterally outwardly from the center sill 12 adjacent the longitudinal ends of the car 10. Each of the bolsters 50 supports container support structures 52 secured to upper flanges 54 of the bolsters 50. Containers (not shown) deposited on the car are secured to anchors or mounts indicated schematically at 56 to prevent undesirable displacement of the containers during the train movement. These anchors 56 may include one of a variety of container securement structures such as a T-shaped, eyelet or hooklike structure attached to corner plate 58 carried by the bolster 50.

A series of parallel crossbearers 18 are welded to the top portion of the center sill 12 and the channel-shaped side sills 15. Crossbearer 18, side sills 15, crossbearer 26, and bolsters 50 form a grid supporting the load and absorbing forces applied to the car. The top flange or plate 32 of the center sill 12 and top portions 54 of bolsters 50, crossbearer 26, webs 18 and side sill top flange 62 lie substantially in one plane.

The car 10 is configured to receive thereon a single container between 40 and 48 feet in length, or two 20-foot containers. When two 20-foot containers are placed on the car, each container has one end secured to the anchors 58 on a respective bolster 50. The opposite end of each container rests on pad 64 on crossbearer 24, and is secured against lateral movement by container guides or shoes 38 engaging the lateral side of the end of each container. To support the lateral loads, guiding shoes 38 are provided with a vertical face panel 65 and a brace portion 66.

The channel-shaped side sills 15 may be replaced by boxlike or I-beam structures which would increase the car weight. The use of light upright channels reduces the car weight without losing the effectiveness of the car operation. The light side sills 15 rigidify the car grid and participate in the container weight distribution among other supporting members. The side sills span between and abut the crossbearer sections 28 and are connected with plates 67 supported on the container support structures 52 on a pair of channel-like stiffeners or reinforcing beams 70 attached to the center sill side walls 44 run on both sides thereof through the cut-off openings 72 in the crossbearer sections 28. These beams 70 serves as supports and connection for the inner ends of the webs 18 with the center sill. They are narrow and are substantially centered between the top and bottom walls of the center bolster and are spaced therefrom.

A method of attachment of a crossbearer 28 or a web 18 to the center sill 12 is illustrated by FIGS. 6 and 7. A portion 74 of a metal mount plate 76 is welded to the center sill top plate 32 and the sill side wall 44. Then the top surface 78 of the plate 76 secured by a filet weld 79 to the edge 80 of the sill top plate 32. A cantilevered portion 82 of the mount plate 76, extends outwardly from top plate 32 and supports a top plate 30 of the crossbearer 28 during assembly. The crossbearer top plate 30 projecting above a cut-out corner 84 of the crossbearer 28 slides on the mount plate portion 82 during assembly and rest thereon while the top plate 32 of the center sill 12 is welded to top plate 30 of crossbearer 24 by butt weld 86, which provides a structure well suited to bearing the generally tensile forces in the upper plate 30 to upper plate 32 of the center sill 12. The cut-out portion 84 in the body of the crossbearer follows a contour of the mount plate.

Figure 4:
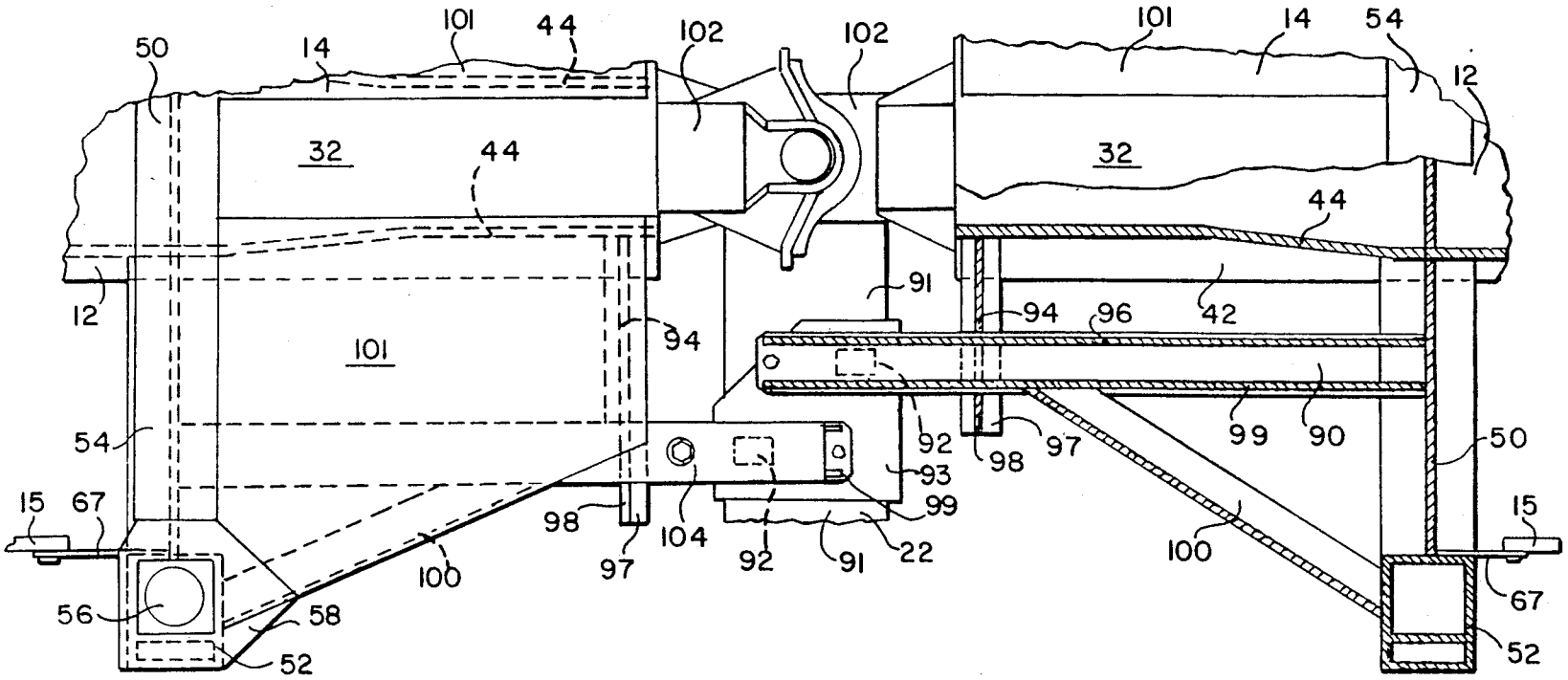
FIG. 4 is a perspective view of an embodiment of the articulated connection between two spine cars.
Figure 5:
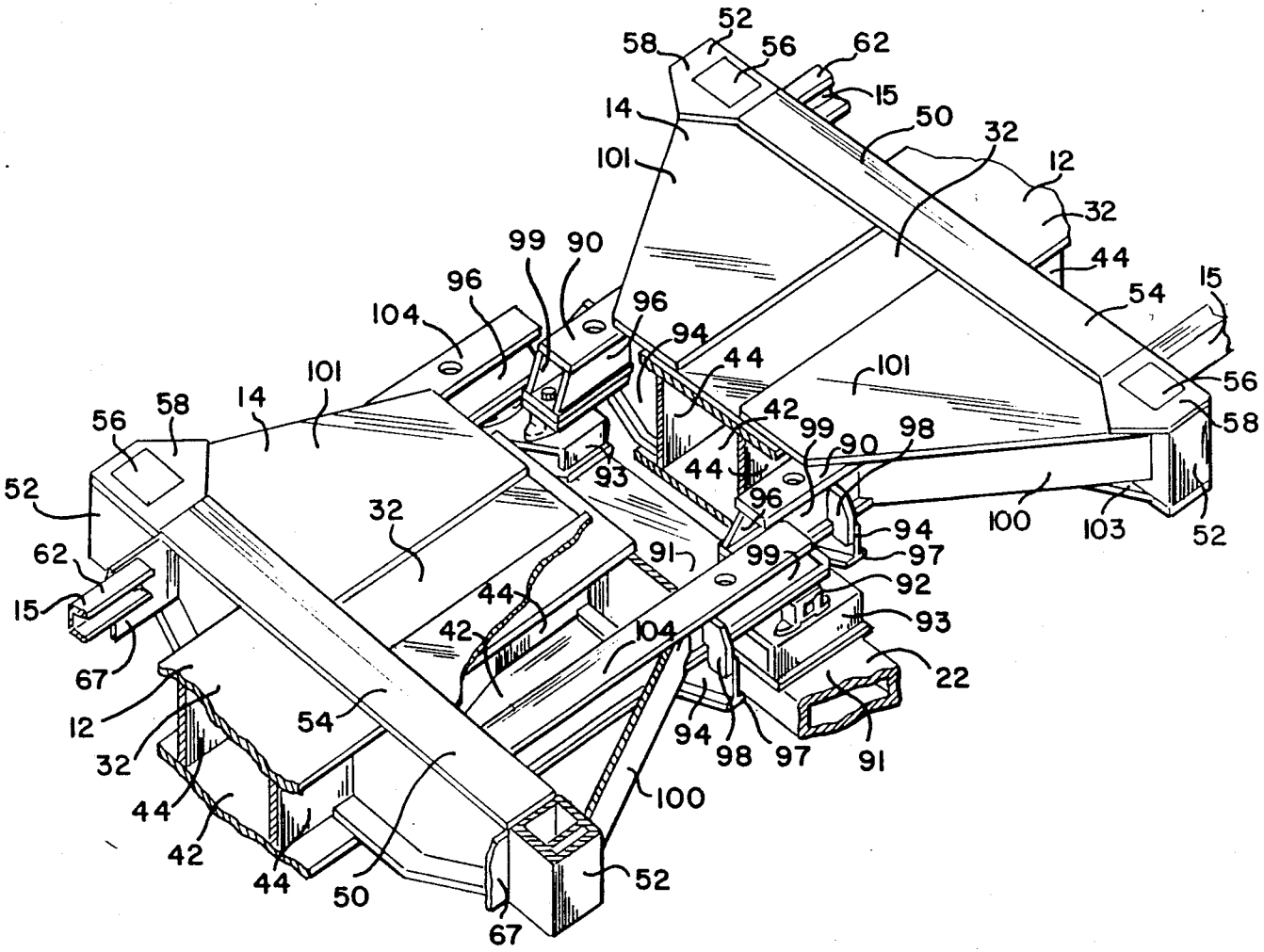
FIG. 5 is a top view of the articulated connection with the shear plate partly cut-away to show the supporting end frame structure.

The end frame structure 14, best shown in FIGS. 4, and 5, includes a pair of parallel brackets or side bearing arms 90 cantilevered to extend longitudinally outward from the bolster 50. Brackets 90 extend above the body 91 of the truck 22. Each bracket 90 has a wear plate connected with its lower wall. Each wear plate engages respective bearings 92 on support structures 93 on the truck body 91 to limit tilt of the car with respect for the truck 22.

Each wear plate is secured to the bracket 90 by fasteners such as bolts connecting with the lower wall of the bracket 90. An opening is provided in the top wall of the bracket 90 which opening is substantially directly above the longitudinally inward fastener to provide access thereto for replacement of the wear plate. The tube-like brackets 90 have a generally rectangular cross-section.

The end sill or frame enclosure member 94 covers the end of the car and extends between the walls 44 of the center sill 12 and the inward side walls 96 of brackets 90. The frame enclosure member 94 includes a lower flange 97 which extends below the bracket 90 to support member 98 engaging the outer wall 99 of the brackets 90 as shown in FIG. 5.

Diagonal braces 100 are provided extending between brackets 90 and container support structures 52 on bolster 50. Braces 100 may be angle or channel members, or be beams of a variety of configurations. Braces 100 form a truss structure with brackets 90 which supports brackets 90, and also aids in beaming impact loads received at the container support structure 52 to the end wall 94 and to the center sill 12.

The container support structure 52 is vertically deeper then the brace 100. To enhance load transfer therebetween, a sloping member 103 extends between the bottom plate of the container support structure and the brace 100.

The shear plate 101 is welded to the center sill top plate 32, the end sills 94, the bolster 50, the brackets 90, and the braces 100 and serves to reinforce the frames defined by these members. The shear plates 101 cover and reinforce the trapezoidal frames formed by the diagonal braces 100, enclosure member and bolster 50, and center sill 22. The trapezoidal frames taper longitudinally outwardly to the brackets 90.

The hollow brackets 90 and a center sill end 46 project outwardly of the end frame 20. The end 46 carries either a female or male part of an articulated connector 102. The brackets 90 of one car project into the space defined by the opposing brackets 104 on the adjacent car. Each intermediate car has a narrow-spaced set of brackets 90 at one end and a wide-spaced set 104 at another. The end frame structure supporting the narrow-spaced brackets 90 and the wide-spaced brackets 104 is essentially the same.

The above described arrangement permits greater articulation of the adjacent cars, reinforces the rigidity of the end frame structure, and decreases the weight of the car by eliminating the corners of conventional end frames having a rectangular configuration. Still another advantage is that the trapezoidal end frames better withstand angular and shear forces applied to the moving car. The shear plates distribute the dynamic buff and draft loadings between the bolster 50 and the center sill 12.

Another advantage of the subject invention is that conventional heavy side sills are replaced with light channel-like stiffeners interconnecting the ends of webs.

The center sill is reinforced with longitudinal side stiffeners.

Use of triangular webs which are laterally shorter than the crossbearer and bolsters, and interconnected by light side sills or stiffeners, further lighten the car in comparison with conventional spine cars. The parallel webs or ribs mounted near the top of the center sill serve as braces. The side sill is attached to the crossbearer and the bolsters in an area located between the center sill and the outer ends of the crossbearer and bolsters.

While one embodiment of the invention has been illustrated and described herein, various changes and modifications may be made therein without departing from the spirit of the invention as defined by the scope of the appended claims.

What is claimed is:

1. A freight railcar for transporting containers comprising a single continuous load-opposing center sill extending along a longitudinal axis of said freight car from end to end thereof and having an upper load carrying side lying in a horizontal plane a series of webs extending transversely of the center sill and having upper edges spaced below said plane; light stiffener members interconnecting the ends of said webs;

and an end frame structure located at each end of the car;

each said end frame structure including straight cantilevered bearing beams projecting toward an adjacent car and beyond the respective end frame structure.

2. The railcar of claim 1 and a swivelable truck supporting adjacent ends of said cars; and an articulated connector located between said cantilever bearing beams; and thin reinforcing beams on opposite sides of the center sill connected thereto and having top and bottom sides respectively spaced from the top and bottom sides of the center sill.

3. The railcar of claim 1, and said end frame structures having a trapezoidal configuration;

a transverse bolster connected to the center sill, angled braces reinforcing said cantilevered bearing beams and located outside thereof so as to form sloping sides of said trapezoidal frame, said braces extending toward the respective bearing beams from opposite ends of the bolster and connected thereto.

4. The railcar of claim 1, wherein said center sill has a boxlike cross-section and said reinforcing beams comprising a channel beam welded to each side of the center sill and extending lengthwise thereof.

5. The railcar of claim 1, and a center crossbearer normal to said center sill dividing said car and comprising a plate having a substantially triangular shape attached to each side of said center sill, and reinforcing beams extending through said plate and connected therewith.

6. The railcar of claim 1, wherein each of said webs has a substantially triangular configuration;

one side of each of said webs being rigidly secured to said center sill and terminating in a lower notched edge, and a combined reinforcing and mounting beam secured to a side of said center sill intermediate the top and bottom thereof and extending through said notched edge.

7. The railcar of claim 1 and a shear plate covering said end frame structure and having a substantially trapezoidal configuration, and said bearing beams projecting straight outwardly of the respective end portion, and a support member extending laterally from the center sill and supporting a respective bearing beam from intermediate its ends.

8. A railcar of claim 1, and heavy load bearing pair of bolsters and crossbar extended across the center sill;

said center sill having a thick center portion and decreased depth end portions;

said bolsters of the pair disposed at the opposite ends of said thick portion; and and guides for preventing undesirable displacement of cargo being mounted on said bolsters and crossbearer.

9. An articulated railway trains including a series of freight railcars, and comprising;

spine cars each having a center sill with transverse parallel webs, a crossbearer and bolsters extending across the center sill, said center sill crossbearer and bolster having load bearing areas lying in a common plane above the upper edges of said webs;

a swivel truck supporting ends of adjacent cars;

a pair of straight cantilevered bearing beams projecting outwardly from each car end, at least one car having a rectangular end frame and a trapezoidal end frame;

top plate means covering said center sill, crossbearer, bolster and said trapezoidal end frame;

said bearing beams freely extending toward and laterally offset with respect to opposing bearing beams of an adjacent car and lying therewith in a common horizontal plane; and relatively light side stiffeners interconnecting ends of said webs.

10. A railway freight car comprising a center sill extending along a longitudinal axis of the car;

a series of generally triangular webs extending across the center sill;

a stiffener interconnecting ends of said webs;

a bolster located at each end of the car;

end frame structures attached to said bolsters;

said structures including a pair of cantilevered bearing beams; an enclosure wall extending across said bearing beams;

a shear plate covering said bearing beams and enclosure wall, and said bearing beams freely projecting outwardly of said enclosure wall in a longitudinal direction; and a support wall connected to said enclosure wall and extending under the inner ends of said bearing beams, and a second support beam extending from a side of said center sill under each bearing beam intermediate the ends thereof and connected therewith.

11. The railway car of claim 10, wherein said bearing beams have a rectangular cross-section and said side stiffeners have a channel shape; and said enclosure wall includes a cross-beam extending between said bearing beams.

12. The railcar of claim 10, and a pair of center sill stiffeners attached to each side of said center sill and having a width substantially less than the depth of the center sill.

13. The railcar of claim 10, and a center crossbearer extending across said center sill; and said enclosure wall including a crossbeam having a rectangular cross section.

14. The railcar of claim 13, a top plate of said crossbearer and a top plate of said center sill being substantially coplanar with said shear plate.

15. The railcar of claim 10, and said webs being shorter than said crossbearer and said bolsters.

16. The railcar of claim 10, and said center sill having decreased depth at each end thereof.

17. The railcar of claim 10, and a set of narrow-spaced cantilevered bearing beams being located at one end of said railcar and a wide-spaced set at another.

18. The railcar of claim 13, and a center crossbearer being coterminous with said bolsters; and said webs being mounted to said center sill, connecting means extending from the top of said center sill beyond the lateral sides thereof, each web having a cut-out beneath the connecting means for admitting the same therein, and means including weld-means connecting the web at said cut-out to said connecting means.

19. A railway car comprising:

a railway car truck rollingly supported on a pair of rails;

a center sill pivotally supported on the truck;

an end member connected with the center sill and extending generally laterally therefrom;

a bolster member connected with the center sill longitudinally inward from the end member and extending generally laterally from the center sill;

the truck having bearing means thereon;

a cantilever supported bearing arm member fixedly connected with the end member, said bearing arm member extending above and engaging the bearing means for limiting tilt of the railway car with respect to the truck, and support means extending from said center sill beneath said arm member intermediate the ends thereof in an area between the adjacent outer end of the center sill and said bolster member.

20. The invention according to claim 19, and a shear plate member connected with the center sill, the end member, the bearing arm member, and the bolster member to aid in support of loads therein.

21. The invention according to claim 19, and the bolster member having a container support structure thereon, said container support structure including a securing means for securing a container on the railway car; and a brace member connected with the bolster member and with the bearing arm member to form a truss structure for supporting impact loads in the container support structure.

22. The invention according to claim 19, and a shear plate member connected with the end member, the center sill, the bolster member, and the brace member for reinforcing the railway car to bear impact loads in the container support structure.

23. A rail car comprising:

a center sill extending from end to end of the car and having top and bottom and lateral sides;

said center sill having a strong deep load-supporting center portion and shallow end portions;

a plurality of crossbearers extending laterally from opposite sides of said center portion and having inner edges connected to adjacent lateral sides thereof, and narrow reinforcing beams connected to the lateral sides of the center portion intermediate the top and bottom sides thereof and extending longitudinally of the center sill through apertures in said crossbearers and providing a connection and support therefore.

24. The invention according to claim 23, and said reinforcing beams being channel-shaped and having upper and lower legs butted against the adjacent lateral side of center section of the beam and weld-connected thereto.

25. The invention according to claim 23, and, end sections connected with the center sill end portions, transverse end bolsters connected to said center sill at the juncture of said center section with said end sections, and means providing load-carrying areas on the opposite ends of said bolsters.

26. The invention according to claim 25, and and an intermediate bolster connected to said center section of the center sill section intermediate the end thereof and having apertures intermediate its top and bottoms sides admitting said reinforcing beam therethrough.

27. A freight rail car for transporting containers comprising a single load-opposing center sill extending along a longitudinal axis of said freight car from end to end thereof and having an upper side lying in a horizontal plane, support beams connected to said center sill and extending laterally outwardly therefrom, container supports on said support beams, a series of webs extending transversely from opposite sides of the center sill and terminating in distal ends, said webs having upper edges spaced below said plane, light stiffener members interconnecting said distal ends of said webs at each side of the center sill, and an end frame structure located at each end of the car, at least one of said frame structures including straight cantilevered bearing beams projecting toward an adjacent car and beyond the respective end frame structure, said upper side of the center sill adapted to support portions of a container in the event of rupture of the container or failure of said supports.

28. The invention according to claim 27, and said supports normally mounting said container at an elevation with its bottom side above the upper side of the center sill.

* * * * *